US009775445B2

(12) United States Patent
Burns et al.

(10) Patent No.: US 9,775,445 B2
(45) Date of Patent: Oct. 3, 2017

(54) COLLAPSIBLE SWING FRAME

(71) Applicant: KIDS II, INC., Atlanta, GA (US)

(72) Inventors: Stephen R. Burns, Cumming, GA (US); John Matthew Thomson, Johns Creek, GA (US); Chaitanya Tadipatri, Alpharetta, GA (US)

(73) Assignee: KIDS II, INC., Atlanta, GA (US)

( * ) Notice: Subject to any disclaimer, the term of this patent is extended or adjusted under 35 U.S.C. 154(b) by 0 days.

(21) Appl. No.: 15/136,411

(22) Filed: Apr. 22, 2016

(65) Prior Publication Data

US 2016/0309915 A1 Oct. 27, 2016

Related U.S. Application Data

(60) Provisional application No. 62/152,845, filed on Apr. 25, 2015, provisional application No. 62/215,943, filed on Sep. 9, 2015.

(51) Int. Cl.

| | |
|---|---|
| ***A63G 9/12*** | (2006.01) |
| ***A47D 1/00*** | (2006.01) |
| ***A47D 13/10*** | (2006.01) |
| ***A47D 7/01*** | (2006.01) |
| ***A47D 13/06*** | (2006.01) |
| ***A47D 1/02*** | (2006.01) |
| ***A47B 13/16*** | (2006.01) |
| *A47D 1/08* | (2006.01) |

(52) U.S. Cl.

CPC ..... *A47D 1/008* (2013.01); *A47B 13/16* (2013.01); *A47D 1/02* (2013.01); *A47D 7/01* (2013.01); *A47D 13/063* (2013.01); *A47D 13/105* (2013.01)

(58) Field of Classification Search

CPC ... A63G 9/00; A63G 9/02; A63G 9/12; A63G 9/16; A47D 1/00; A47D 1/08; A47D 13/00

USPC ..... 472/118–125; 297/273, 274, 344.18

See application file for complete search history.

(56) References Cited

U.S. PATENT DOCUMENTS

| | | | |
|---|---|---|---|
| 341,238 | A | 5/1886 | Heinss |
| 1,463,571 | A | 7/1923 | Brame |
| 1,702,190 | A | 2/1929 | Anello |
| 1,866,175 | A | 7/1932 | Rogers, Jr. |
| 2,443,786 | A | 6/1948 | Cooper |
| 2,562,616 | A | 7/1951 | Hudson |
| 2,753,921 | A | 7/1956 | Heinzelman, Jr. |
| 2,807,309 | A | 9/1957 | Saint et al. |
| 3,119,124 | A | 1/1964 | Krauss |

(Continued)

FOREIGN PATENT DOCUMENTS

| | | | |
|---|---|---|---|
| CN | 1662284 | A | 8/2005 |
| CN | 102440597 | A | 5/2012 |
| WO | 03092841 | A1 | 11/2003 |

*Primary Examiner* — Kien Nguyen

(74) *Attorney, Agent, or Firm* — Gardner Groff Greenwald & Villanueva, PC

(57) ABSTRACT

A collapsible swing frame for supporting a child receiving receptacle includes first and second support members, and upper swing mechanism, and a cross-brace pivotally coupled between the first and second support members. Preferably, the collapsible swing frame is movable between an expanded configuration and a collapsed configuration. Preferably, the cross-brace provides a rigid and substantially supportive connection between the first and second support members.

30 Claims, 7 Drawing Sheets

(56) References Cited

U.S. PATENT DOCUMENTS

| | | | |
|---|---|---|---|
| 3,146,985 | A | 9/1964 | Grudoski |
| 3,166,287 | A | 1/1965 | Pasqua |
| 3,206,772 | A | 9/1965 | Sarasin |
| 3,256,016 | A | 6/1966 | Berlin |
| 3,309,718 | A | 3/1967 | Sarasin |
| 3,420,523 | A | 1/1969 | Foster |
| 3,459,423 | A | 8/1969 | Meade |
| 3,526,400 | A | 9/1970 | Carpenter et al. |
| 3,667,756 | A | 6/1972 | Barrett |
| 3,794,317 | A | 2/1974 | Barrett |
| 3,883,136 | A | 5/1975 | Kim |
| 3,990,667 | A | 11/1976 | Tomalinas, Jr. |
| 4,022,510 | A | 5/1977 | Saint |
| 4,150,820 | A | 4/1979 | Bochmann |
| 4,165,872 | A | 8/1979 | Saint |
| 4,181,299 | A | 1/1980 | Foster |
| 4,211,401 | A | 7/1980 | Cunard |
| 4,240,625 | A | 12/1980 | Meeker |
| 4,323,233 | A | 4/1982 | Gebhard |
| 4,324,432 | A | 4/1982 | Eldon, III et al. |
| 4,325,578 | A | 4/1982 | Borucki |
| 4,573,224 | A | 3/1986 | Saint |
| 4,635,305 | A | 1/1987 | Wyss |
| 4,688,280 | A | 8/1987 | Kohus et al. |
| 4,739,527 | A | 4/1988 | Kohus et al. |
| 4,785,678 | A | 11/1988 | McGugan et al. |
| 4,822,033 | A | 4/1989 | Kohus et al. |
| 5,083,773 | A | 1/1992 | Saint |
| 5,326,327 | A | 7/1994 | Stephens et al. |
| 5,376,053 | A | 12/1994 | Ponder et al. |
| 5,378,196 | A | 1/1995 | Pinch et al. |
| 5,525,113 | A | 6/1996 | Mitchell et al. |
| 5,562,548 | A | 10/1996 | Pinch et al. |
| 5,593,207 | A | 1/1997 | Turner |
| 5,628,689 | A | 5/1997 | Saint et al. |
| 5,769,727 | A | 6/1998 | Fair et al. |
| 5,788,014 | A | 8/1998 | Saint et al. |
| 5,791,999 | A | 8/1998 | Lauro et al. |
| 5,846,136 | A | 12/1998 | Wu |
| 5,975,631 | A | 11/1999 | Fair et al. |
| 6,010,410 | A | 1/2000 | Lauro et al. |
| 6,022,277 | A | 2/2000 | Jankowski |
| 6,027,409 | A | 2/2000 | Favorito et al. |
| 6,059,667 | A | 5/2000 | Pinch |
| 6,193,224 | B1 | 2/2001 | Dillner et al. |
| 6,251,023 | B1 | 6/2001 | Lauro et al. |
| 6,277,028 | B1 | 8/2001 | Liu |
| 6,283,870 | B1 | 9/2001 | Saint et al. |
| 6,319,138 | B1 | 11/2001 | Fair et al. |
| 6,339,304 | B1 | 1/2002 | Allison et al. |
| 6,343,994 | B1 | 2/2002 | Clarke |
| 6,386,986 | B1 | 5/2002 | Sonner et al. |
| 6,421,901 | B2 | 7/2002 | Sitarski et al. |
| 6,471,597 | B1 | 10/2002 | Flannery et al. |
| 6,500,072 | B1 | 12/2002 | Myers et al. |
| 6,511,123 | B1 | 1/2003 | Sitarski et al. |
| 6,520,862 | B1 | 2/2003 | Armbruster et al. |
| 6,544,128 | B1 | 4/2003 | Yang |
| 6,561,915 | B2 | 5/2003 | Kelly et al. |
| 6,626,766 | B1 | 9/2003 | Hsia |
| 6,645,080 | B1 | 11/2003 | Greger et al. |
| 6,687,928 | B1 | 2/2004 | Wilson |
| 6,692,368 | B1 | 2/2004 | Hyun |
| 6,702,685 | B2 | 3/2004 | Mahlstedt et al. |
| 6,824,472 | B2 | 11/2004 | Armbruster et al. |
| 6,824,473 | B2 | 11/2004 | Wu |
| 6,857,966 | B2 | 2/2005 | Armbruster et al. |
| 6,872,146 | B1 | 3/2005 | Paesang et al. |
| 6,875,117 | B2 | 4/2005 | Ransil et al. |
| 6,887,161 | B2 | 5/2005 | Mahlstedt et al. |
| 6,896,624 | B2 | 5/2005 | Longenecker et al. |
| 6,902,230 | B2 | 6/2005 | Chen |
| 6,902,489 | B2 | 6/2005 | Greger et al. |
| 6,908,397 | B2 | 6/2005 | Armbruster et al. |
| 6,908,398 | B1 | 6/2005 | Kang |
| 6,994,630 | B2 | 2/2006 | Paesang |
| 7,037,205 | B1 | 5/2006 | Bowman |
| 7,052,403 | B2 | 5/2006 | Ransil et al. |
| 7,081,052 | B2 | 7/2006 | Greger et al. |
| 7,189,164 | B1 | 3/2007 | Paesang et al. |
| 7,219,959 | B2 | 5/2007 | Ransil et al. |
| 7,252,594 | B2 | 8/2007 | Armbruster et al. |
| 7,258,617 | B2 | 8/2007 | Chen |
| 7,258,618 | B2 | 8/2007 | Haut |
| 7,258,619 | B2 | 8/2007 | Tuckey |
| 7,275,996 | B2 | 10/2007 | Dillner et al. |
| 7,275,997 | B2 | 10/2007 | Hsia |
| 7,326,120 | B2 | 2/2008 | Bellows et al. |
| 7,329,192 | B2 | 2/2008 | Gibree |
| 7,354,352 | B2 | 4/2008 | Keska et al. |
| 7,422,524 | B2 | 9/2008 | Gregorian |
| 7,434,279 | B2 | 10/2008 | Chen et al. |
| 7,445,559 | B2 | 11/2008 | Kakuda |
| 7,445,560 | B2 | 11/2008 | Greger et al. |
| 7,475,942 | B2 | 1/2009 | Boyle et al. |
| 7,506,922 | B2 | 3/2009 | Schulte et al. |
| 7,507,163 | B2 | 3/2009 | Haut |
| 7,695,374 | B2 | 4/2010 | Bellows et al. |
| 7,780,237 | B2 | 8/2010 | Chen et al. |
| 7,819,485 | B2 | 10/2010 | Hartenstine et al. |
| 7,837,570 | B2 | 11/2010 | Kwon |
| 7,878,915 | B2 | 2/2011 | Myers et al. |
| 7,905,791 | B2 | 3/2011 | Guang et al. |
| 7,918,499 | B2 | 4/2011 | Tuckey et al. |
| 7,959,514 | B2 | 6/2011 | Chen et al. |
| 7,971,933 | B2 | 7/2011 | Tuckey et al. |
| 8,057,318 | B2 | 11/2011 | Chen |
| 8,066,577 | B2 | 11/2011 | Chen et al. |
| 8,070,617 | B2 | 12/2011 | Barron et al. |
| 8,118,684 | B2 | 2/2012 | Kelly et al. |
| 8,142,297 | B2 | 3/2012 | Zhang |
| 8,152,647 | B2 | 4/2012 | Tuckey et al. |
| 8,292,750 | B2 | 10/2012 | Gregorian |
| 8,308,578 | B2 | 11/2012 | Gilbert et al. |
| 8,357,054 | B2 | 1/2013 | Myers et al. |
| 8,376,461 | B2 * | 2/2013 | Chen ..... A47D 1/08 297/130 |
| 8,403,767 | B2 | 3/2013 | Zhang |
| 8,407,832 | B2 | 4/2013 | Galley |
| 8,419,558 | B2 | 4/2013 | Zhang |
| 8,419,559 | B2 | 4/2013 | Zhang |
| 8,491,051 | B2 | 7/2013 | Zhang |
| 8,491,401 | B2 | 7/2013 | Szymanski |
| 8,491,402 | B2 | 7/2013 | Yeh et al. |
| 8,517,849 | B2 | 8/2013 | Tuckey |
| 8,550,556 | B2 | 10/2013 | Asbach |
| 8,636,601 | B2 | 1/2014 | Zhang et al. |
| 8,678,942 | B2 | 3/2014 | Zhang |
| 8,784,225 | B2 | 7/2014 | Burns et al. |
| 8,795,097 | B2 | 8/2014 | Chapman et al. |
| 8,900,063 | B2 | 12/2014 | Lin |
| 8,920,253 | B2 | 12/2014 | Horst et al. |
| 8,944,927 | B2 | 2/2015 | Huntsberger et al. |
| 2002/0052245 | A1 | 5/2002 | Flannery et al. |
| 2003/0160487 | A1 | 8/2003 | Flannery et al. |
| 2003/0199329 | A1 | 10/2003 | Wood et al. |
| 2004/0259647 | A1 | 12/2004 | Wood et al. |
| 2005/0014569 | A1 | 1/2005 | Greger et al. |
| 2005/0143181 | A1 | 6/2005 | Armbruster et al. |
| 2007/0010338 | A1 | 1/2007 | Wu et al. |
| 2007/0049390 | A1 | 3/2007 | Wu et al. |
| 2007/0207870 | A1 | 9/2007 | Armbruster et al. |

* cited by examiner

COLLAPSIBLE SWING FRAME

CROSS-REFERENCE TO RELATED APPLICATIONS

This application claims the benefit of U.S. Provisional Patent Application Ser. No. 62/152,845 filed Apr. 25, 2015, and U.S. Provisional Patent Application Ser. No. 62/215,943 filed Sep. 9, 2015, the entireties of which are hereby incorporated herein by reference for all purposes.

TECHNICAL FIELD

The present invention relates generally to the field of infants' and children's products, and more particularly to a child swing assembly including a collapsible swing frame for supporting a child receiving receptacle.

BACKGROUND

An infant swing includes a support frame and a seat (or other child receiving receptacle) movably supported by the support frame for providing a swinging motion to a child seated therein. It may be desirable to provide infant swings with a foldable or collapsible support frame, for compact storage and transport. However, some known collapsible support frames for swings have been perceived as lacking sufficient structural rigidity or stability when unfolded for use, such that a caregiver may feel uncomfortable seating a child in the seat. Additionally, some known infant swings are difficult or unwieldy to transport or move about a living space.

Needs exist for continuing improvements in this field of endeavor. It is to the provision of a collapsible swing frame meeting these and other needs that the present invention is primarily directed.

SUMMARY

In example embodiments, the present invention provides a collapsible swing frame for supporting a child receiving receptacle, the frame including first and second supports, an upper swing mechanism, and a cross-brace pivotally coupled between the first and second supports. The cross-brace provides a substantial rigid connection between the first and second supports, and provides stability to the frame. In example embodiments, the collapsible frame is movable between an expanded configuration and a collapsed configuration, with a coupling joint provided between the cross-brace, which can include a locking mechanism for locking the cross-brace in an expanded configuration, or for permitting pivotal movement of the cross-brace. The swing frame optionally also includes wheeled base hubs, for improved portability and ease of use.

In one aspect, the present invention relates to a children's swing device including a folding swing frame. The folding swing frame preferably includes first and second supports and a folding cross-brace. Each of the first and second supports preferably includes a base portion, an upright portion and an intermediate portion between the base portion and the upright portion. The first and second supports are preferably pivotally coupled to one another to allow folding of the swing frame between an expanded configuration and a collapsed configuration. The folding cross-brace is preferably connected between the first and second supports at their intermediate portions proximal the base portions In another aspect, the present invention relates to a children's swing device including a folding swing frame. The folding swing frame preferably includes a ground-contacting base structure having first and second base portions, and a folding cross-brace. The folding cross-brace preferably includes first and second cross-members hingedly connected to one another at inner ends thereof, and preferably pivotally connected to the first and second base portions at outer ends thereof.

In still another aspect, the present invention relates to a children's swing device including a folding swing frame and a child receiving receptacle supported by the folding swing frame. The folding swing frame preferably includes first and second supports, each of the first and second supports having a base portion, an upright portion and an intermediate portion between the base portion and the upright portion. The folding swing frame preferably also includes an upper swing mechanism supporting the child receiving receptacle, and pivotally coupling upper ends of the upright portions of the first and second supports to allow folding of the swing frame between an expanded configuration and a collapsed configuration. The folding swing frame preferably also includes a folding cross-brace connected between the first and second supports proximal the base portions, the folding cross-brace preferably including first and second cross-members hingedly connected to one another at inner ends thereof, and being pivotally connected to the first and second supports at outer ends thereof.

In another aspect, the present invention relates to a cross-brace for a collapsible swing frame having a first and a second support member. The cross-brace includes a first cross-member, a second cross-member, and a coupling joint. The first cross-member includes a first end and a second end. The first end of the first cross-member is pivotally coupled to the first support member. The second cross-member includes a first end and a second end. The first end of the second cross-member is pivotally coupled to the second support member. The coupling joint pivotally connects the second ends of the first and second cross-members together.

In example embodiments, the first and second cross-members and the coupling joint provide stability to the collapsible swing frame. In example embodiments, with the first and second cross-members axially aligned with each other, and with the second end of the first cross-member aligned and facing towards the second end of the second cross-member, a rigid and substantially supportive connection is provided between the first and second support members.

In another aspect, the invention relates to a collapsible swing frame including first and second support members, an upper swing mechanism, and a cross-brace. The first and second support members each include a first end and a second end. The upper swing mechanism is configured for pivotal coupling engagement with the first ends of the first and second support members, wherein the first and second support members are movable relative to each other with respect to the upper swing mechanism between an expanded configuration and a collapsed configuration. The cross-brace is pivotally coupled to the first and second support members, wherein the cross-brace is expandable and collapsible to accommodate positioning the first and second support members in the expanded and collapsed configurations. Preferably, the first and second cross-members and the coupling joint provide stability to the first and second support members.

In example embodiments, each of the first and second support members includes a base portion, an intermediate radiused portion, and an upright leg portion. In example embodiments, the cross-brace includes first and second cross-members and a coupling joint pivotally coupling the first and second cross-members together. In example embodiments, the first and second cross-members have first ends and second ends, and wherein the first ends generally extend in a direction substantially perpendicular to the extension of the second ends. In example embodiments, second ends of the first and second cross-members are coupled to the coupling joint to provide for pivotal movement between an expanded configuration with the first and second cross-members axially aligned and facing each other, and a collapsed configuration with the first and second cross-members angled with respect to each other. In example embodiments, the coupling joint includes a movable shuttle member for locking the first and second cross-members in the expanded configuration, and for unlocking the first and second cross-members such that they can be collapsed.

In example embodiments, a brace connector hub is provided for mounting to each of the intermediate radiused portions of the first and second support members, and wherein the first ends of the first and second cross-members are pivotally mounted to the brace connector hubs, respectively. In example embodiments, a wheel is rotatably mounted to a portion of each of the brace connector hubs. In example embodiments, with the first and second cross-members axially aligned with each other, and with the second end of the first cross-member aligned and facing towards the second end of the second cross-member, a rigid and substantially supportive connection is provided between the first and second support members.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description are exemplary and explanatory of example embodiments of the invention, and are not restrictive of the invention, as claimed.

DETAILED DESCRIPTION OF EXAMPLE EMBODIMENTS

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
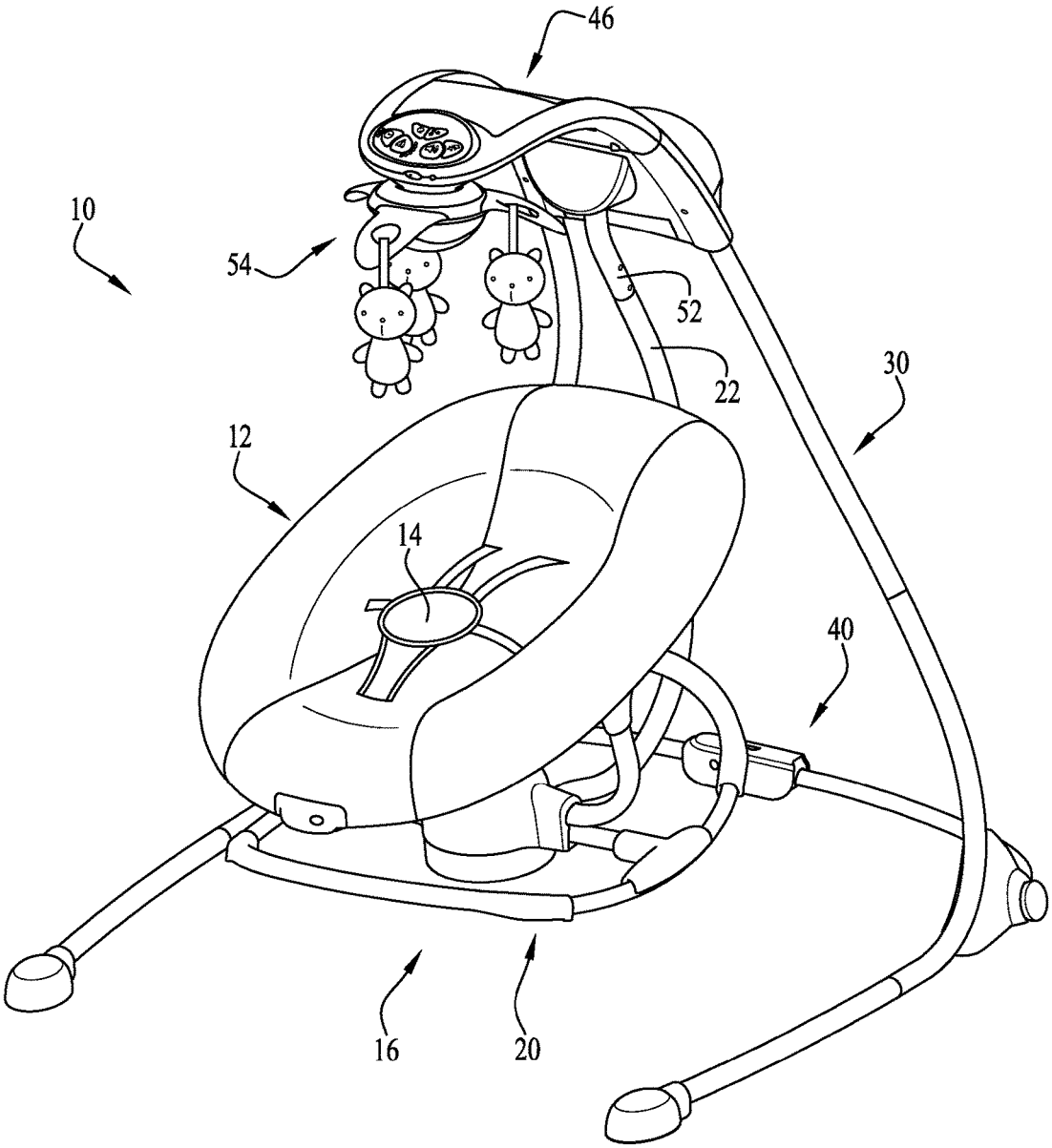
FIG. 1 is a front perspective view of an infant swing according to an example embodiment of the present invention, the infant swing having an infant support structure and a collapsible swing frame.
Figure 2:
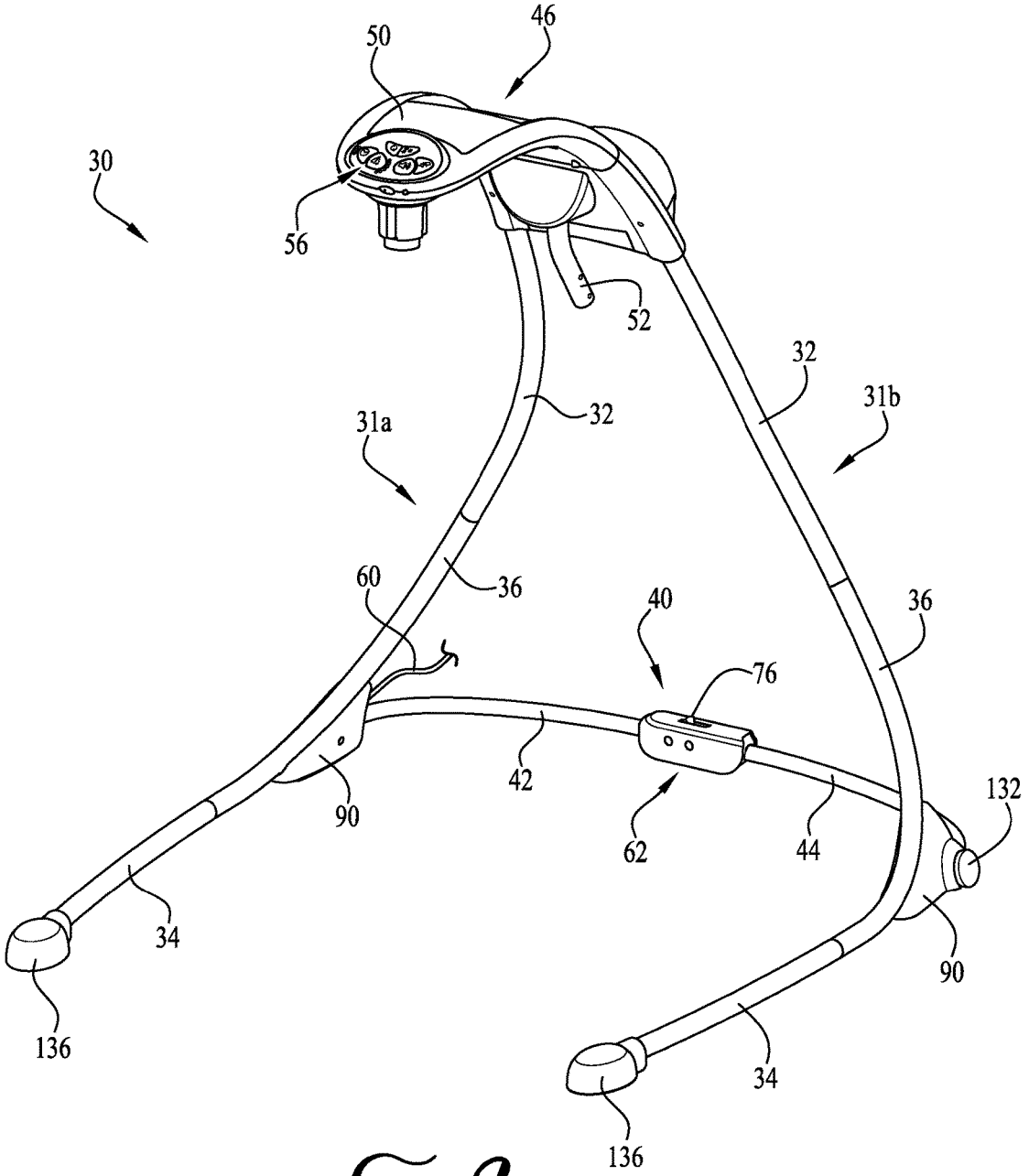
FIG. 2 is a front perspective view of the collapsible swing frame of FIG. 1, with the infant support structure removed to show additional detail of the frame.
Figure 4:
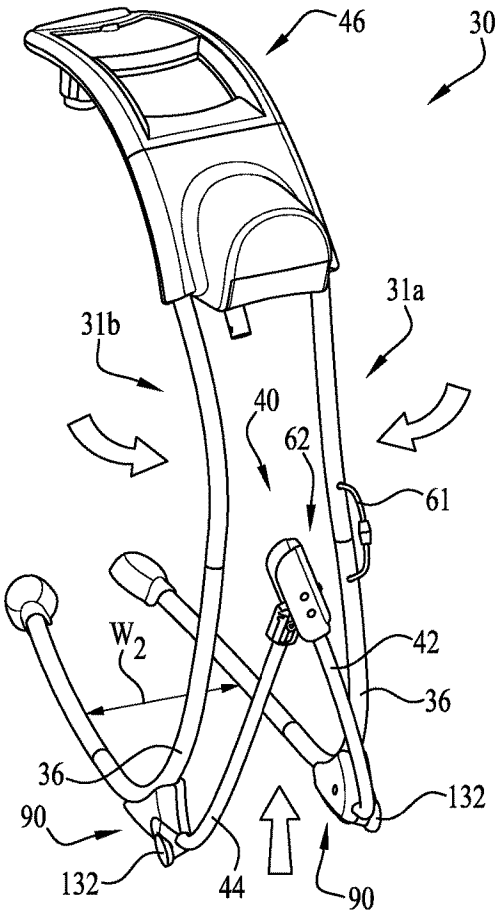
FIG. 4 shows a rear perspective view of the collapsible swing frame of FIG. 1, showing the collapsible swing frame in a collapsed configuration.
Figure 3:
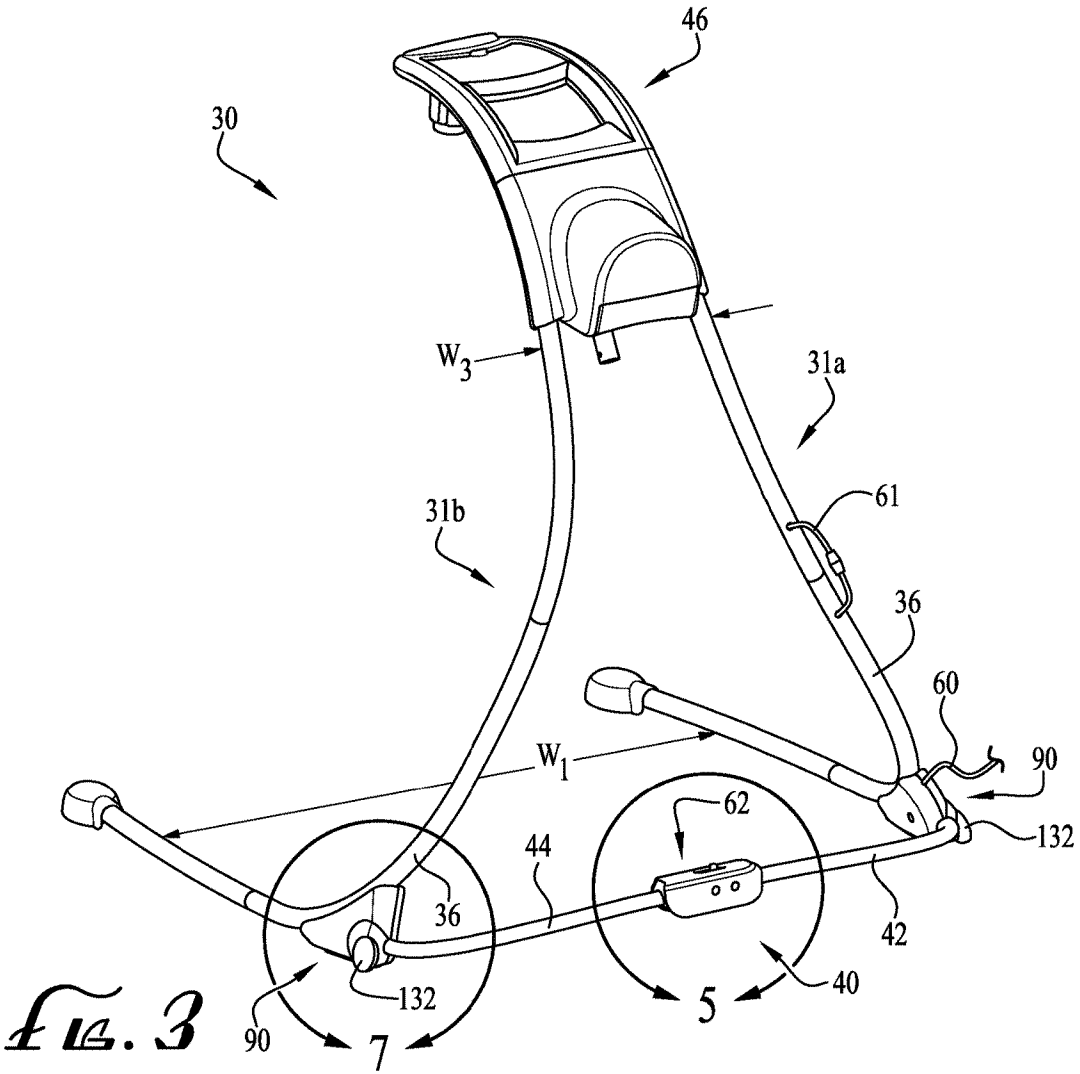
FIG. 3 is a rear perspective view of the collapsible swing frame of FIG. 1, showing the collapsible swing frame in an expanded configuration.
Figure 5:
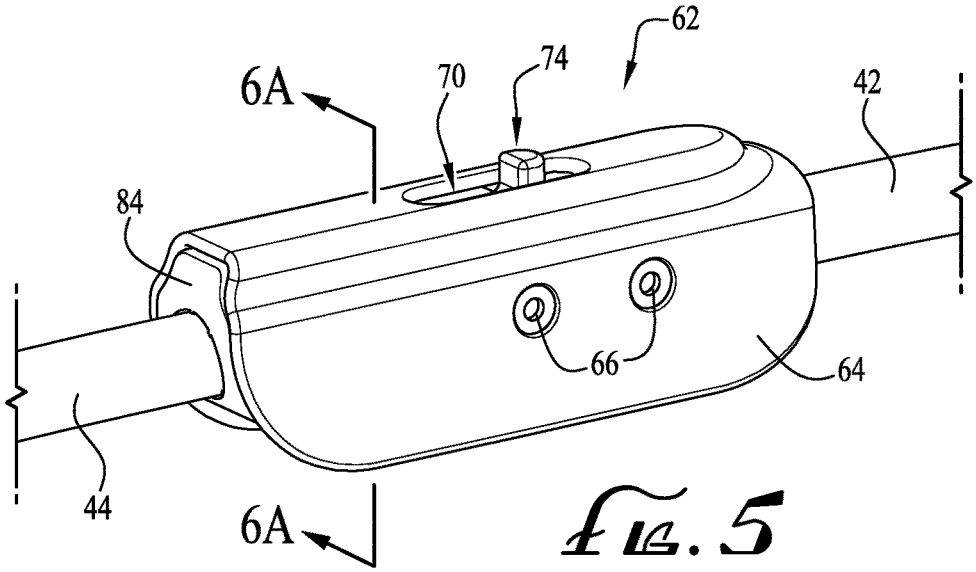
FIG. 5 is a detailed, close-up perspective view of a cross-brace coupling joint of the collapsible swing frame of FIG. 1, in its expanded configuration.

With reference now to the drawing figures, wherein like reference numbers represent corresponding parts throughout the several views, FIG. 1 shows an infant or child swing assembly 10 comprising an infant receiving receptacle 12 and a collapsible frame 30 for supporting the infant receiving receptacle 12, for example, on a support or ground surface and supporting the infant receiving receptacle 12. FIGS. 2-4 show the collapsible frame 30 with the infant receiving receptacle 12 removed. In example embodiments, the infant receiving receptacle 12 is configured for receiving a child and is capable of movement relative to the collapsible frame 30 to provide a soothing, swinging motion. A restraint harness 14 can be provided with the child receiving receptacle 12 for securing the child within the child receiving receptacle 12. In some example forms, the restraint harness 14 can include a harness adjustment mechanism for adjusting the fit of the restraint harness 14. The harness adjustment mechanism can include a strap operably coupled to the harness such that pulling on the strap tightens the fit of the restraint harness 14. Optionally, the harness adjustment mechanism can be configured for one-handed operation.

In example embodiments, the child receiving receptacle 12 is supported by a child receptacle support assembly 16, which generally includes a base support assembly 20. A swing rod 22 extends between the swing frame 30 and the child receptacle support assembly 16. In example embodiments, the swing rod 22 is coupled to a portion of the base support assembly 20, and extends generally arcuately and upwardly from the base support assembly 20 for coupling engagement with a swing rod extension member 52 that extends from an upper swing mechanism 46 (as will be described below). The swing rod 22 optionally includes detachable couplings at one or both ends for detachably connecting with the base support assembly 20 and/or with the swing rod extension member 52. Alternatively the swing rod 22 can be permanently or semi-permanently attached to the base support assembly 20 and/or to the swing rod extension member 52. In further alternate embodiments, the swing rod 22 and the swing rod extension member 52 comprise a single unitary component, or can comprise two or more separate sections with couplings for attachment. In example embodiments, the child receiving receptacle 12 is rotationally or repositionably coupled to the swing rod 22, to allow a caregiver to adjust the swing orientation and/or incline of the child receiving receptacle, for example to convert between a side-to-side swinging motion and a front-to-back swinging motion. In further alternate embodiments, two or more swing rods or other supports are provided. In example embodiments, the swing 10 is a full size child or infant swing device. In still other embodiments, the child receiving receptacle 12 and support assembly 16 can be decoupled from the swing frame 30 and can be used separately and apart from the same. For instance, in such embodiments, the child receiving receptacle 12 and support assembly 16 can serve as a separate bouncer, rocker, sleeper, child seat, bassinet, or any other child receiving apparatus.

FIG. 2 shows the collapsible frame 30 in an expanded configuration with the child receiving receptacle 12 and child receiving support assembly 16 disengaged therefrom. In example embodiments, the swing frame 30 comprises a first and a second foldable support 31*a*, 31*b*, a cross-brace 40 generally pivotally connected between the first and second foldable supports 31*a*, 31*b*, and the upper swing mechanism 46 mounted to a portion of each of the first and second foldable supports 31*a*, 31*b*. In example embodiments, each of the first and second foldable supports 31*a*, 31*b* generally comprise an upright leg member 32, a base member 34, and an intermediate radiused or angled member 36 connected between the base member and the upright leg member. In example form, the upright leg member 32, the base member 34 and the intermediate radiused member 36 are separable parts, and are configured for removable coupling engagement together to form the first and second foldable supports 31*a*, 31*b*, for example by slip fitting of post and ferrule tubing sections. In example embodiments, the ends of the members 32, 34, 36 can be configured to provide removable interengagement therebetween, for example, so that an end of the base member 34 is coupled to a first end of the intermediate radiused member 36 and an end of the upright leg member 32 is coupled to a second end of the intermediate radiused member 36. Alternatively, each of the first and second supports 31*a*, 31*b* can be formed from a generally unitary or singular support, wherein the upright leg member 32, the base member 34 and the intermediate radiused member 36 are sections of a unitary component. In example embodiments, the members 32, 34 and 36 are formed from steel or aluminum tubing comprising a generally circular cross-sectional shape. In alternate embodiments, the tubing can be formed from other materials (e.g., plastics, composites, other metals, etc.) and can comprise other cross-sectional shapes, for example, oval, square, elliptical, etc.

In example forms, the first and second supports 31*a*, 31*b* are generally L-shaped, for example, wherein a portion of the supports 31*a*, 31*b* (e.g., base members 34) are provided for placement extending generally horizontally on a ground surface, and a portion of the supports 31*a*, 31*b* (e.g., the upright leg members 32) are generally provided for generally vertical or upward extension from the ground surface to support the upper swing mechanism 46 and the child receptacle support assembly 16 removably coupled thereto, with the intermediate members 36 being curved or angled to connect the leg members 32 at an offset angle relative to the base members 34, for example of about 60°-90°. In example embodiments, the upper swing mechanism 46 is generally coupled to a portion of the collapsible frame 30, for example, the upper ends of the upright leg members 32 and/or a support bracket mounted at upper ends of the leg members. In example embodiments, the upper ends of the upright leg members 32 are pivotally or hingedly mounted to a housing 50 of the upper swing mechanism 46 such that the first and second supports 31*a*, 31*b* can fold or pivot between the expanded configuration (FIGS. 2 and 3) and a collapsed or folded configuration (see FIG. 4).

The upper swing mechanism 46 generally comprises the housing 50, and the swing rod extension 52 for coupling engagement with the swing rod 22. Alternatively, the swing rod 22 and swing rod extension 52 can be one component, for example formed form a continuous length of tubing. In example embodiments, the swing rod extension 52 is coupled to a motor, electromagnetic drive, or other motive mechanism for providing movement to the swing rod extension 52, for example, so that movement (e.g., swinging motion) of the swing rod extension 52 causes swinging or rocking movement to the child receptacle support assembly 16 (and thus the child receiving receptacle 12). In example embodiments as described above, the upper ends of the first and second foldable supports 31*a*, 31*b* are pivotally coupled to a bottom receiving portion of the housing 50 incorporating a hinge mechanism to provide for folding movement of one or both of the foldable supports 31*a*, 31*b* relative to each other, for example, such that the swing frame can be positioned in the expanded configuration (see FIGS. 2 and 3) and the collapsed configuration (see FIG. 4).

The upper swing mechanism 46 optionally comprises a mobile or toy bar 54 including one or more entertainment features or toys for entertaining the child seated within the child receiving receptacle 12 (see FIG. 1). In example embodiments, one or more speakers are optionally provided for outputting audible sounds or music, and/or connections are provided for portable electronic devices for playing music or audiovisual entertainment. The swing 10 can be powered, for example, by connection with an electrical outlet or with batteries, to provide for powering the motor or other motive device, the speakers, etc. As depicted in FIG. 2, wiring 60 can be provided for powering the upper swing mechanism 46, for example, by connecting the wiring 60 to a power source (e.g., electrical outlet). As depicted in FIG. 3, a wire 61 is electrically connected to the power cord 60 by an electrical connector for extending through the upper leg portion 32 and further within the upper swing mechanism 46. Optionally, an AC adapter can be provided on the cord 60. The upper swing mechanism 46 and/or the housing 50 can optionally comprise user-selectable controls 56 for controlling operation of the swing and/or accessories such as the speed and/or amplitude of the swing, volume of music or audible sounds, and the period of time for which the child receiving receptacle 12 will swing.

In example embodiments, the upper swing mechanism 46 and/or the housing 50 can comprise an internally-housed circuit board or other wiring configuration to allow for operation of the user-selectable controls 56, swinging movement of the child receiving receptacle 12, outputting audible sounds, etc. According to some example forms, one or more soothing or entertainment devices such as lights, vibrations, or other entertainment features can be incorporated within the upper swing mechanism 46 and/or the swing assembly 10. Optionally, the upper swing mechanism 46 can be configured to communicate with an electronic device, for example, a smart phone, tablet, etc. such that music or other features, software or applications of the electronic device (generally stored in memory thereon) can be utilized through operation of the upper swing mechanism 46.

A cross-brace 40 is pivotally coupled to the first and second supports 31*a*, 31*b*, for example, at or near the base members 34 or the intermediate radiused portions 36, for example, to provide support and rigidity to the leg members, and to provide stability to the collapsible frame 30. In example embodiments, the cross-brace 40 substantially prevents movement of the first and second supports 31*a*, 31*b* relative to each other. Preferably, the cross-brace 40 is positioned on the first and second supports 31*a*, 31*b* near their engagement with the ground surface, for example, at a position along the base members and/or the intermediate radiused portions 36. Preferably, with the cross-brace 40 position generally near the points of contact of the supports 31*a*, 31*b* with the ground or support surface, movement of the supports 31*a*, 31*b* is substantially eliminated. In example embodiments, the cross-brace 40 forms the base of a generally isosceles or equilateral triangular support structure for the swing 10, the upright leg members 32 of the supports 31*a*, 31*b* forming the legs of the triangle, and with the upper swing mechanism 46 forming the apex of the triangle. Positioning the cross-brace 40 at the base of the swing, extending along and immediately adjacent and parallel with the ground or support surface, and optionally contacting the ground or support surface at one or more points along the cross-brace, provides improved structural rigidity and stability to the swing 10 when in use, reducing or eliminating wobble of the swing and flexing of the frame 30 in its expanded configuration.

The cross-brace 40 preferably comprises a foldable linkage of two or more segments, for example comprising a first cross-member 42, a second cross-member 44, and a coupling hinge or joint 62 positioned between and pivotally coupling inner ends of the first and second cross-members 42, 44 together. In example form, and as shown in FIGS. 3-4, the first and second cross-members 42, 44 each comprise a generally L-shaped section of tubing, with outer ends of the cross-members bent substantially perpendicular to their main lengths, for pivotal engagement with brace connector hubs 90 mounted to the intermediate radiused portion 36 of each support 31*a*, 31*b*, to allow folding of the cross-brace 40. The hinged connection between the inner ends of the cross-members 42, 44 to one another, and the pivotal connection of the outer ends of the cross-members to the first and second supports 31*a*, 31*b* allows the swing frame 30 to be folded from its expanded configuration for use to a more compact collapsed configuration without detachment of the cross-brace 40 from the first and second supports.

In example form, the coupling joint 62 comprises a locking and unlocking mechanism (described in greater detail herein) for locking the cross-brace 40 in an expanded configuration, for example, wherein the cross-members 42, 44 are generally axially aligned with each other and positioned generally horizontally. FIG. 3 shows the collapsible frame 30 in an expanded configuration with the cross-brace 40 in its expanded configuration and with the coupling joint 62 in a locked position for preventing pivotal movement of the second ends of the cross-members 42, 44 relative to the coupling joint 62. The locking and unlocking mechanism of the coupling joint 62 preferably permits unlocking of the cross-members 42, 42, for example, such that the cross-members 42, 44 can be collapsed or folded relative to each other. FIG. 4 shows the collapsible frame 30 in its collapsed configuration with the cross-members generally angled upwardly, for example, such that an angle of 90 degrees or less is defined between the cross-members 42, 44.

According to example embodiments, when the collapsible frame 30 is in the expanded configuration, a width $W_1$ is defined between the first and second supports 31*a*, 31*b* at a base portion thereof (e.g., portion of the supports generally in close proximity to the ground surface) and, when the collapsible frame 30 is in a collapsed configuration, a width $W_2$ is defined between the first and second supports 31*a*, 31*b* at the base portion (or between the base members 34). According to example embodiments, the expanded base width $W_1$ is between about 24 inches to about 48 inches, more preferably between about 28 inches to about 44 inches, for example about 36 inches according to one example embodiment. The collapsed base width $W_2$ is between about 2 inches to about 16 inches, more preferably between about 4 inches to about 14 inches, for example about 8 inches according to one example embodiment. According to example embodiments, a top frame width $W_3$ is defined between the first and second supports 31*a*, 31*b* near their pivotal connection with the upper swing mechanism 46, for example, which generally remains substantially similar in either of the expanded configuration or the collapsed configuration. According to example embodiments, the width $W_3$ is between about 2 inches to about 16 inches, more preferably between about 4 inches to about 14 inches, for example about 8 inches according to one example embodiment. Thus, in example embodiments, the expanded base width $W_1$ is at least about two times the top width $W_3$, and in further examples $W_1$ is at least three times the top width $W_3$; and the collapsed base width $W_2$ is approximately equal to, and preferably less than two times the top width $W_3$.

Preferably, an adult caregiver or user can easily grasp and unlock the coupling joint 62, for example to permit pivotal movement of the cross-members 42, 44 such that the collapsible frame can be folded to the collapsed configuration. Similarly, when the collapsible frame 30 is in the collapsed configuration, the user can easily spread apart the supports 31*a*, 31*b* until the cross-members 42, 44 are generally substantially horizontal, for example wherein the coupling joint 62 locks the cross-members 42, 44 together such that pivotal movement therebetween is prevented.

FIGS. 5 and 6A-6C show the locking and unlocking mechanism of the hinged coupling joint 62 in greater detail. In example embodiments, the coupling joint 62 comprises an outer U-shaped housing or shell 64, which defines a generally central release-receiving channel 70 for providing access to an actuating tab 76 of a movable shuttle member 74 that is movable within the shell 64. In example embodiments, screws or fasteners 66 are provided for fixedly mounting the second end of the first cross-member 62 within a portion of the shell 64 (via mounting hole 43) and pivotally mounting the second end of the second cross-member 44 within a portion of the shell 64 (via mounting hole 45). Thus, in example forms, the second end of the first cross-member is fixedly engaged with the coupling joint 62 and the second end of the second cross-member 44 is pivotally mounted with the coupling joint 62. In example embodiments, an interengagement collar 84 is coupled to a portion of the second end of the second cross-member 44 to provide for interengagement with the shell 64 (see FIG. 5), and comprises a recessed channel or orifice 86 formed therein for receiving a portion of the movable shuttle member 74. A recessed channel or orifice 72 is provided within a portion of the shell 64, for example, for receiving the biasing member 82 and for permitting movement of at least a portion of the movable shuttle member 74 therein. As seen best with reference to FIGS. 3 and 5, the lower edges or base of the shell 64 of the coupling joint 62 optionally contacts the ground or other support surface upon which the swing 10 rests when the swing frame 30 is in its expanded configuration and the coupling joint is locked, providing additional structural bracing and stability.

Figure 6A:
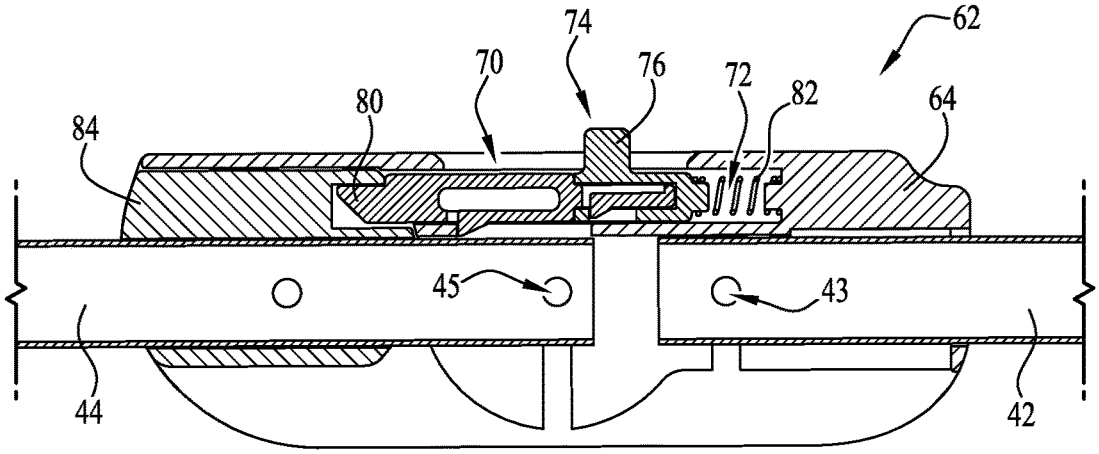
FIG. 6A is a cross-sectional view of the cross-brace coupling joint of FIG. 5, showing coupling joint in a locked configuration and wherein an end finger portion of a movable shuttle member is in a locked position.
Figure 6B:
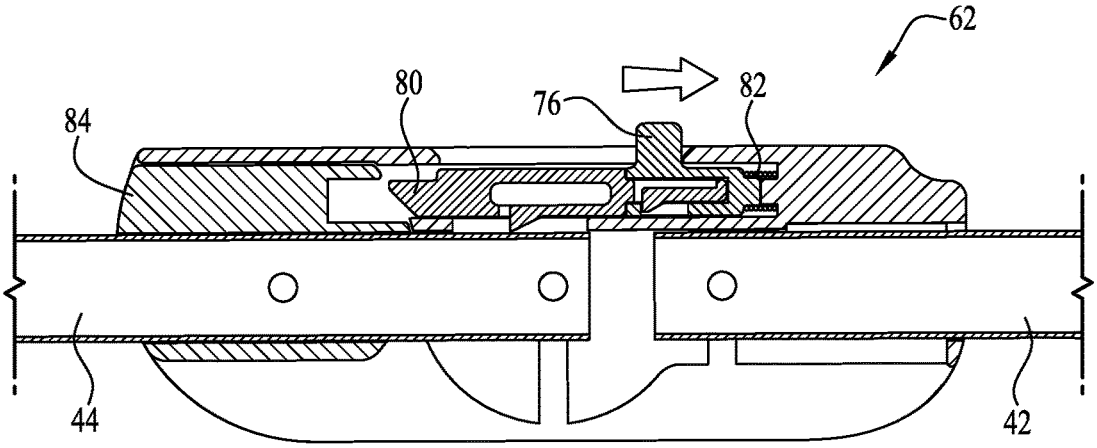
FIG. 6B is a cross-sectional view of the coupling joint of FIG. 5, showing the end finger portion of the movable shuttle member retracted and in an unlocked position.
Figure 6C:
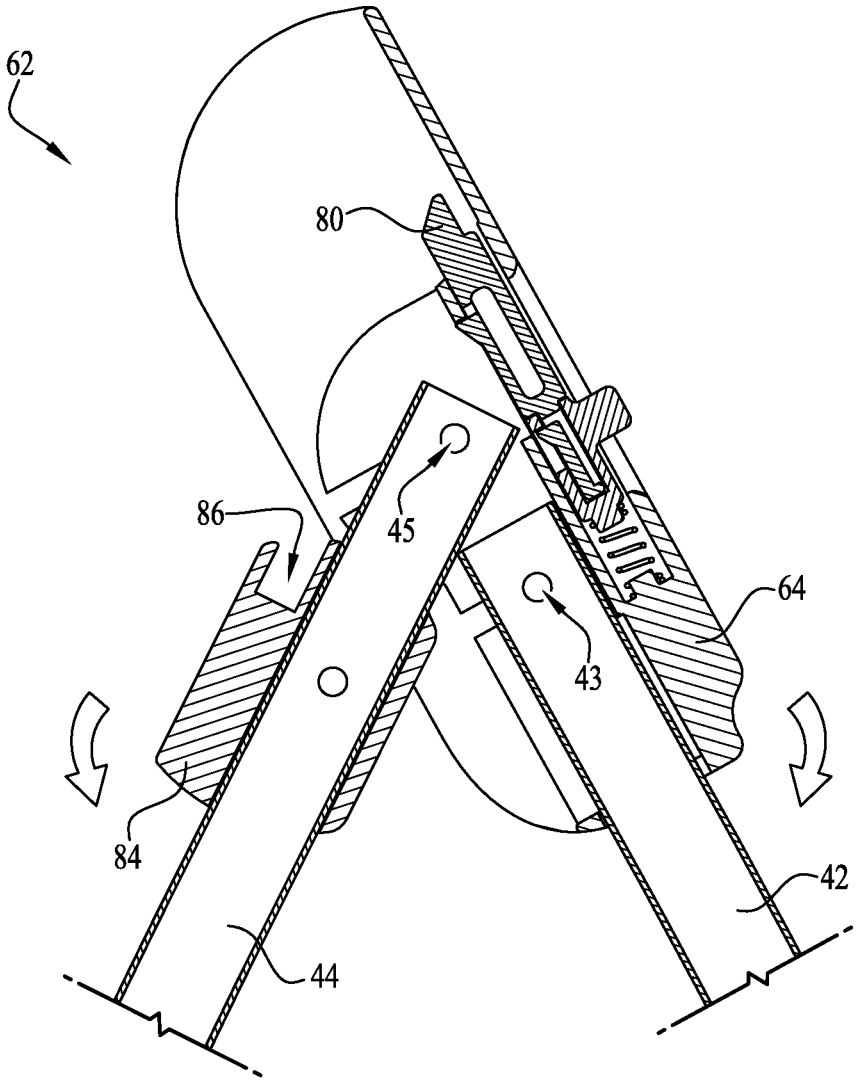
FIG. 6C is a cross-sectional view of the coupling joint of FIG. 5, showing first and second members of the cross-brace folded relative to each other in a folded, collapsed configuration.

As shown in FIG. 6A, the coupling joint 62 is in a locked configuration with the movable shuttle member 74 in a locked position. The second ends of the first and second cross-members 42, 44 are generally axially aligned and facing each other, and the interengagement collar 84 is engaged within the shell 64. Preferably, an end finger portion 80 of the movable shuttle member 74 is biased by the biasing member 82 to be positioned within the recessed channel 86 of the interengagement collar 84, for example, such that the movable shuttle member 74 is in the locked position, thereby causing the coupling joint to be in the locked configuration and prevent pivotal movement of the cross-members 42, 44 relative to each other. As shown in FIG. 6B, to unlock the coupling joint 62, the actuating tab 76 that is movable within the channel 70 is actuated such that the end finger portion 80 is removed from the recessed channel 86 of the interengagement collar 84 (e.g., causing compression of the biasing member 82), and the second cross-member 44 can then pivot relative to the first cross-member 42 such that the cross-members 42, 44 can be collapsed and folded relative to each other, for example so that the cross-members are generally angled upwardly.

In example forms, a portion of the end finger portion 80 can be angled or chamfered, for example, such that the movable shuttle member 74 does not need to be actuated or retracted when unfolding the cross-members 42, 44 from the collapsed configuration to the expanded configuration. For example, as the movable shuttle member 74 is biased by the biasing member 82 to generally remain in the locked position unless actuated by the user (see position of shuttle member 74 in FIG. 6C), the angled portion of the end finger portion 80 accommodates engagement with the interengagement collar 84 (or portions of the recessed channel 84) such that the movable shuttle member 74 is forced to retract upon axial alignment of the cross-members 42, 44. In alternate example embodiments, the coupling joint 62 can preferably be configured to provide for selectively locking and unlocking the cross-members 42, 44, for example, to either provide a substantially rigid cross-brace when in the expanded configuration, or to provide for pivotal movement between the cross-members 42, 44 such that the frame 30 can be collapsed. Optionally, other locking mechanisms, hinges, releases, actuating members, etc. can be provided for permitting selective pivotal movement of the cross-members 42, 44.

Figure 7:
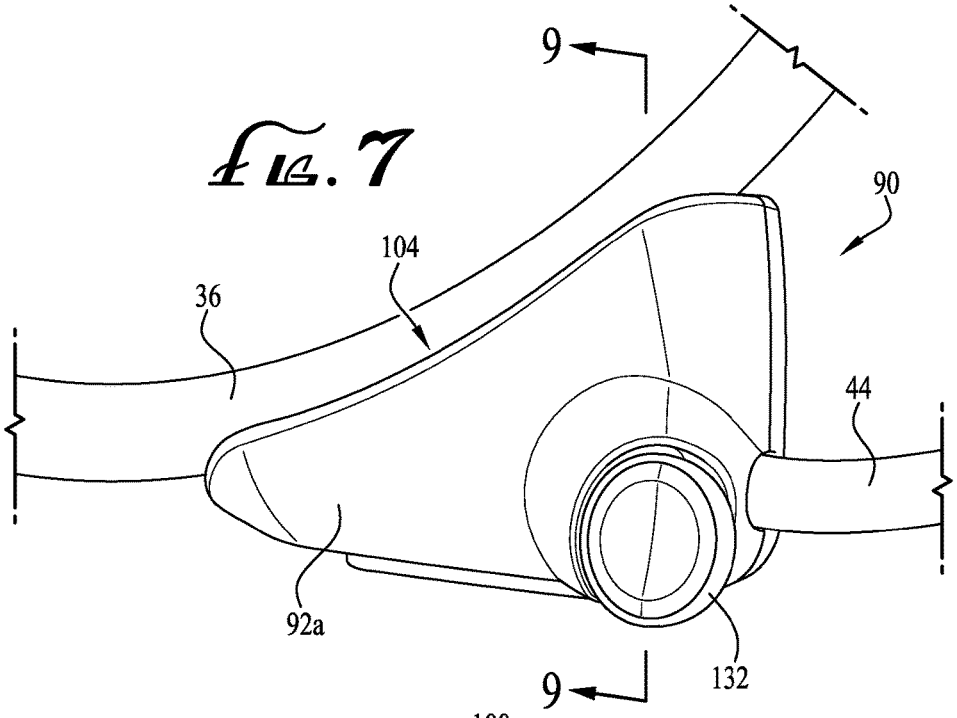
FIG. 7 is a detailed, close-up perspective view of a brace connector hub of the swing frame shown in FIG. 1.
Figure 8:
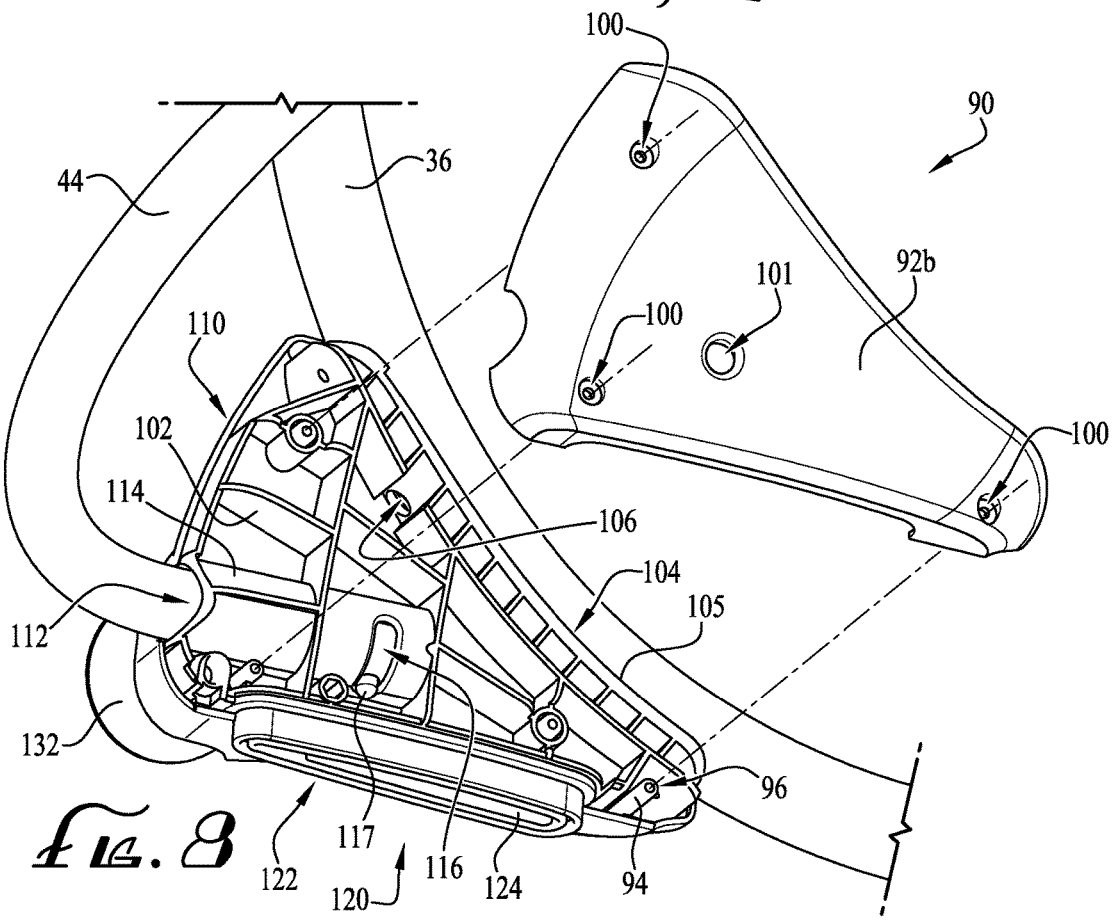
FIG. 8 is a partial exploded assembly view of the brace connector hub of FIG. 7.
Figure 9:
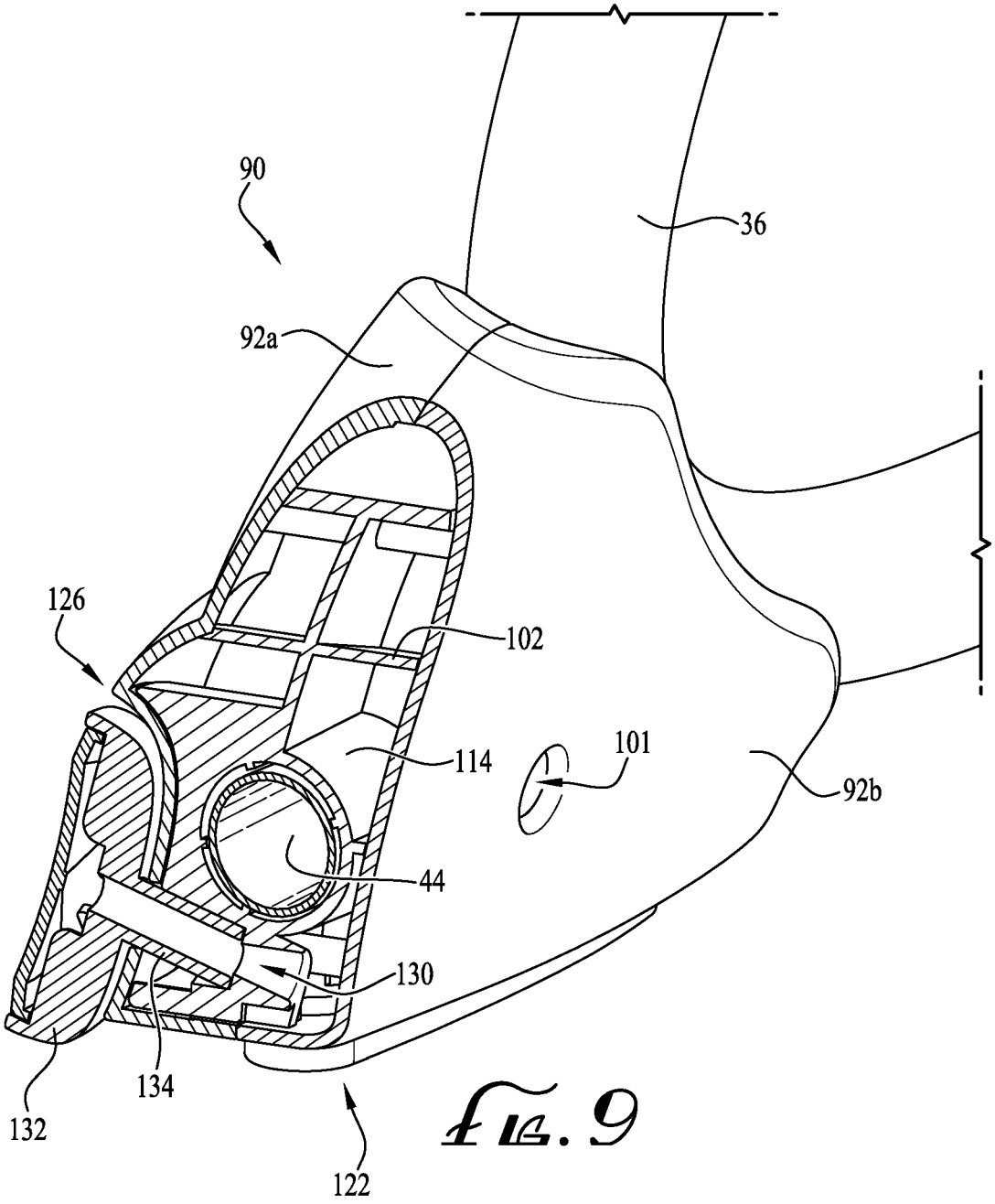
FIG. 9 is a cross-sectional view of the brace connector hub of FIG. 7 taken along line 9-9.

FIGS. 7-9 show further details of the brace connector hub 90, which is mounted at or adjacent the intermediate radiused portion 36 of each of the support members 31*a*, 31*b* of the collapsible swing frame 30. In example embodiments, the brace connector hub 90 comprises first and second housing shells 92*a*, 92*b* including a radiused engagement portion 104, a rear portion 110, and bottom support portion 120. In example forms, the first and second housing shells 92*a*, 92*b* are generally triangular in shape and generally comprise a smooth outer surface. Optionally, the housing shells 92*a*, 92*b* can be otherwise shaped as desired. In example embodiments, the first housing shell 92*a* is mounted to the intermediate radiused member 36, and the second housing shell 92*b* is coupled to the first housing shell 92*a*. In example embodiments, the first housing shell 92*a* comprises a plurality of alignment pins 94 having fastener receiving portions 96 defined therein, for example, for receiving screws or other fasteners to couple the second housing shell 92*b* with the first housing shell 92*a*. As depicted in FIG. 8, the second housing shell 92*b* comprises a plurality of openings 100 for receiving the fasteners so that the fasteners can be engaged with the fastener receiving portions 96 of the first housing shell 92*a*, for example, to connect the second housing shell 92*b* to the first housing shell 92*a*. According to example embodiments, the first and second housing shells 92*a*, 92*b* can comprise one or more reinforcement ribs 102, for example, for providing rigidity and support to the brace connector hub 90.

In example embodiments, the radiused engagement portion 104 comprises a radiused or curved profile and a generally recessed and radiused surface defined therein for providing engagement with the intermediate radiused portion 36. In example embodiments, one or more mounting openings 106 are formed within the radiused engagement portion 104 for securing the first housing shell 92*a* to the intermediate radiused member 36, for example, with a screw or other fastener. In example embodiments, the brace connector hub 90 is positioned along the intermediate radiused member 36 such that the second cross-member 44 is at least partially offset from the ground surface that is supporting the first and second supports 31*a*, 31*b*. For example, in the expanded configuration (see FIG. 3), the cross-brace 40 (and first and second cross-members 42, 44 thereof) is generally at least partially offset a small distance (for example generally corresponding to the height of the coupling shell 64) from the ground surface. Alternatively, the brace connector hub 90 can be mounted to the intermediate radiused portion 36 such that the second cross-member 44 is engaged with the ground surface in the expanded configuration. Similarly, the first cross-member (and the brace connector hub 90) can be positioned for similar engagement with the ground surface in the expanded configuration.

In example embodiments, the rear portion 110 of the brace connector hub 90 comprises a brace-receiving channel or receiver 112 defining a generally cylindrical housing 114, for example, for receiving the first end of the second cross-member 44. Preferably, the first end of the cross-member 44 is pivotally or rotationally mounted within the cylindrical housing 114 to accommodate pivotal movement of the cross-member 44 between the expanded configuration and the collapsed configuration. The description of the brace connector hub 90, the intermediate radiused portion 36 of the second support member 31*b*, and the second cross-member 44 is applicable and substantially similar to the brace connector hub 90, the intermediate radiused member 36 of the first support 31*a*, and the first cross-member 42.

In example embodiments, an interior guidance channel 116 is formed along a portion of the cylindrical housing 114 so that a snap button guidance pin 117 or other member of the cross-member 44 can be guided and generally restricted to move along the guidance channel 116. Thus, with the guidance channel 116 and the guidance pin 117, the cross-member 44 is capable of pivotal movement relative to the brace connector hub 90, but is not permitted to traverse back and forth along the length of the cylindrical housing 114. In example embodiments, the snap button guidance pin 117 is biased outwardly to generally remain at least partially extended from the cross-member 44, but can be actuated or pushed inwardly to cause disengagement of the guidance pin 117 from the guidance channel 116, for example, so that the cross-member 44 can be disengaged from the brace connector hub 90. In example embodiments, an opening 101 can be provided with the second housing shell 92*b* such that a tool or instrument can extend therethrough for actuating the guidance pin 117, for example, when it is desired to disassemble the cross-members from the brace connector hub 90.

The bottom support portion or foot 120 is generally configured for engagement with the ground surface, for example, to provide for non-slip supporting contact with the ground surface such that the swing frame 30 remains engaged and stable on the ground surface. In example embodiments, a gripping and stabilization insert 122 can be coupled to the bottom support portion 120, for example, which can be formed from rubber or high friction material. An outer contact surface 124 can be shaped and formed as desired, which can comprise one or more surface features for enhancing the frictional engagement with the ground surface. Furthermore, ends of the base members 34 can comprise feet couplings 136 (see FIG. 2), for proving for enhancing the frictional engagement of the base members 34 with the ground surface.

The brace connector hubs 90 optionally include wheels, castors or other rolling support means for rolling transport of the swing 10. In example form, the connector hubs 90 comprise a wheel receiving portion 126 having a central receiver 130 for pivotally coupling a wheel 132 thereto. For example, according to example embodiments, an outer surface portion of the first housing shell 92*a* comprises the wheel receiving portion 126 and the central receiver 130, and a central shaft 134 of the wheel 132 is rotatably mounted within the central receiver 130. According to example embodiments, the wheel receiving portion 126 is generally recessed or inwardly curved for positioning at least a portion of the wheel 134 therein, but at least partially offset from the surface such that the wheel is permitted to rotate. In example embodiments, the wheel 132 (or an outside portion thereof) can be configured to generally be positioned flush with the outer surface of the first housing shell 92*a*. In example embodiments, a fastener or screw is provided for rotatably securing the wheel 132 to the first housing shell 92*a*, for example wherein the fastener is engaged with an internal portion of the first housing shell 92*a* and the central shaft 134 of the wheel 132.

As depicted in FIG. 9, the wheel 132 is preferably at least partially angled and oriented such that the bottom support portion 120 is engaged with the ground surface in either of the collapsed or expanded configurations, but when the frame 30 is tilted rearwardly (e.g., lifting the base members 34 off of the ground surface) causes the wheels 132 to become engaged with the ground surface, for example, so that a user can easily roll and transport the collapsible frame 30 in either of the expanded or collapsed configurations. In alternate embodiments, the wheels 132 can be configured to engage the ground surface in either of the expanded or collapsed configurations, or the wheels 132 can be configured for engagement with the ground surface in the collapsed configuration but generally offset from the ground surface in the expanded configuration. In example embodiments, tilting the frame 30 in either of the expanded or collapsed configurations can provide for engagement of the wheels 132 with the ground surface, for example, to transport the frame 30 and child receiving receptacle 12 optionally coupled thereto.

In an example method of use, an adult caregiver or user sets up the swing 10 with its frame 30 in the expanded configuration with the cross-brace 40 extended and the coupling joint 62 locked, for example as shown in FIG. 1. An infant or small child is placed in the child receiving receptacle 12, and the swing can be operated manually or by powered drive mechanism to gently swing or rock the child for a calming or entertaining effect. As configured, in the expanded configuration the cross-brace 40 extends between the lower base ends of the frame supports 31*a* and 31*b*, generally coplanar with the base members 34, forming a generally rectangular U-shaped ground-contacting base structure. In example embodiments, the cross-brace 40 extends in close proximity to the ground, floor or other support surface upon which the swing 10 is placed, and optionally, at least a portion of the cross-brace (for example the lower edge of the coupling shell 64) engages or contacts the support surface for additional stability. In this manner, the swing frame 30 provides strong structural rigidity and support, and solid stability of the frame during swinging or rocking movement. After use is complete, the child is removed from the child receiving receptacle 12, and the swing frame can be folded or collapsed for compact storage or transport. The user releases or unlocks the coupling joint 62 and lifts the coupling joint to fold the cross-brace 40 (FIG. 4), drawing the frame supports 31*a*, 31*b* inwardly to collapse and fold the frame 30. Optionally, the user tilts the swing frame 30 rearwardly to engage the wheels 132 on the ground, and rolls the swing 10 to another location for storage or further use. To use the swing 10 again, the user spreads the frame supports 31*a*, 31*b* and lowers the cross-brace 40 to position the swing frame 30 back in its expanded configuration, and locks the coupling joint 62, and the sequence of use may be repeated.

While the invention has been described with reference to preferred and example embodiments, it will be understood by those skilled in the art that a variety of modifications, additions and deletions are within the scope of the invention, as defined by the following claims.

What is claimed is:

1. A children's swing device comprising a folding swing frame, the folding swing frame comprising first and second supports and a folding cross-brace, each of the first and second supports comprising a base portion, an upright portion and an intermediate portion between the base portion and the upright portion, wherein the first and second supports are pivotally coupled to one another to allow folding of the swing frame between an expanded configuration and a collapsed configuration, and wherein the folding cross-brace is connected between the first and second supports at their intermediate portions proximal the base portions.

2. The swing device of claim 1, further comprising a child receiving receptacle supported from an upper swing mechanism mounted to upper ends of the upright portions of the first and second supports.

3. The swing device of claim 1, wherein the first and second supports are pivotally coupled to one another by an upper swing mechanism mounted to upper ends of the upright portions of the first and second supports.

4. The swing device of claim 1, further comprising connector hubs mounted to the intermediate portions of the first and second supports, and wherein the folding cross-brace comprises first and second cross-members, the first and second cross-members being hingedly connected to one another at inner ends thereof, and being pivotally connected to the connector hubs at outer ends thereof.

5. The swing device of claim 4, further comprising wheels mounted to the connector hubs.

6. The swing device of claim 1, wherein the folding cross-brace comprises first and second cross-members, the first and second cross-members being hingedly connected to one another at inner ends thereof by a locking coupling joint.

7. The swing device of claim 1, wherein in the expanded configuration of the folding swing frame, the base portions of the first and second supports and the folding cross-brace define a generally U-shaped ground-contacting base structure.

8. The swing device of claim 1, wherein in the expanded configuration of the folding swing frame, the folding cross-brace extends in close proximity to a support surface upon which the base portions of the first and second supports is supported.

9. The swing device of claim 8, wherein in the expanded configuration of the folding swing frame, the folding cross-brace is generally coplanar with the base portions of the first and second supports.

10. The swing device of claim 8, wherein in the expanded configuration of the folding swing frame, at least a portion of the folding cross-brace contacts the support surface.

11. A children's swing device comprising a folding swing frame, the folding swing frame comprising a ground-contacting base structure comprising first and second base portions each base portion comprising a first end and a second end, and a folding cross-brace, the folding cross-brace comprising first and second cross-members hingedly connected to one another at inner ends thereof, and pivotally connected to the first and second base portions at outer ends thereof, wherein the outer end of each cross-member is pivotally connected proximal the second end of each base portion.

12. The swing device of claim 11, further comprising first and second upright portions extending from the first and second base portions, the first and second upright portions being pivotally coupled to one another to allow folding of the swing frame between an expanded configuration and a collapsed configuration.

13. The swing device of claim 12, wherein the first and second upright portions are pivotally coupled to one another by an upper swing mechanism mounted to upper ends of the first and second upright portions.

14. The swing device of claim 13, further comprising a child receiving receptacle suspended to swing from the upper swing mechanism.

15. The swing device of claim 11, further comprising connector hubs connecting the outer ends of the first and second cross-members to the first and second base portions.

16. The swing device of claim 15, wherein the connector hubs are wheeled.

17. The swing device of claim 11, further comprising a locking coupling joint hingedly connecting the inner ends of the first and second cross-members.

18. The swing device of claim 11, wherein in an expanded configuration of the folding swing frame, the ground-contacting base structure defines a generally rectangular U-shaped structure.

19. The swing device of claim 11, wherein in an expanded configuration of the folding swing frame, the folding cross-brace extends in close proximity to a support surface upon which the first and second base portions are supported.

20. The swing device of claim 19, wherein in an expanded configuration of the folding swing frame, at least a portion of the folding cross-brace contacts the support surface.

21. The swing device of claim 11, wherein in an expanded configuration of the folding swing frame, the folding cross-brace is generally coplanar with the first and second base portions.

22. A children's swing device comprising a folding swing frame and a child receiving receptacle supported by the folding swing frame, wherein the folding swing frame comprises:

first and second supports, each of the first and second supports comprising a base portion and an upright portion;

an upper swing mechanism supporting the child receiving receptacle, and pivotally coupling upper ends of the upright portions of the first and second supports to allow folding of the swing frame between an expanded configuration and a collapsed configuration; and a folding cross-brace connected between the first and second supports proximal the base portions, the folding cross-brace comprising first and second cross-members hingedly connected to one another at inner ends thereof, and pivotally connected to the first and second supports at outer ends thereof, wherein the folding cross-brace is connected to each of the first and second supports between the base portion and the upright portion.

23. The swing device of claim 22, wherein the folding cross-brace further comprises a locking coupling joint hingedly connecting the inner ends of the first and second cross-members.

24. The swing device of claim 22, further comprising connector hubs connecting the outer ends of the first and second cross-members to the first and second supports.

25. The swing device of claim 24, wherein the connector hubs have wheels.

26. The swing device of claim 22, wherein in the expanded configuration of the folding swing frame, the base portions of the first and second supports and the folding cross-brace define a generally U-shaped ground-contacting base structure.

27. The swing device of claim 22, wherein in the expanded configuration of the folding swing frame, the folding cross-brace extends in close proximity to a support surface upon which the base portions of the first and second supports is supported.

28. The swing device of claim 22, wherein in the expanded configuration of the folding swing frame, the folding cross-brace is generally coplanar with the base portions of the first and second supports.

29. The swing device of claim 28, wherein in the expanded configuration of the folding swing frame, at least a portion of the folding cross-brace contacts the support surface.

30. The swing device of claim 22, wherein each of the first and second supports comprise an intermediate portion between the base portion and the upright portion, connecting the upright portion to the base portion at an offset angle.

* * * * *